US006692381B2

(12) United States Patent
Sakagami et al.

(10) Patent No.: US 6,692,381 B2
(45) Date of Patent: Feb. 17, 2004

(54) SOLID GOLF BALL

(75) Inventors: Seigou Sakagami, Kobe (JP); Akihiro Nakahara, Kobe (JP); Satoshi Mano, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/103,750

(22) Filed: Mar. 25, 2002

(65) Prior Publication Data

US 2003/0073513 A1 Apr. 17, 2003

(30) Foreign Application Priority Data

Mar. 26, 2001 (JP) ..... 2001-087455

(51) Int. Cl.[7] ..... A63B 37/06
(52) U.S. Cl. ..... 473/377
(58) Field of Search ..... 473/351, 367, 473/368, 371, 376, 377

(56) References Cited

U.S. PATENT DOCUMENTS 4,683,257 A 7/1987 Kakiuchi et al.
5,252,652 A 10/1993 Egashira et al.
5,929,171 A 7/1999 Sano et al.

FOREIGN PATENT DOCUMENTS

| | | |
|---|---|---|
| EP | 0 638 337 A1 | 2/1995 |
| JP | 62-89750 A | 4/1987 |
| JP | 7-51406 A | 2/1995 |
| JP | 2669051 B2 | 7/1997 |
| JP | 2778229 B2 | 5/1998 |
| JP | 10-244019 A | 9/1998 |
| JP | 2000-313710 A | 11/2000 |

*Primary Examiner*—Steven Wong
*Assistant Examiner*—Raeann Gordon
(74) *Attorney, Agent, or Firm*—Birch, Stewart, Kolasch & Birch, LLP

(57) ABSTRACT

The present invention provides a solid golf ball having exceptional rebound characteristics and flight performance, as well as good shot feel. The present invention relates to a solid golf ball comprising at least one layer of a core, and at least one layer of a cover formed on the core, wherein at least one of the layers of the core is formed by vulcanizing and press-molding a rubber composition comprising (a) a base rubber comprising polybutadiene rubber containing a cis-1,4-bond of not less than 99%, (b) a co-crosslinking agent, and (c) an organic peroxide.

10 Claims, 2 Drawing Sheets

SOLID GOLF BALL

FIELD OF THE INVENTION

The present invention relates to a solid golf ball having exceptional rebound characteristics and flight performance, as well as good shot feel.

BACKGROUND OF THE INVENTION

Golf balls can be broadly classified into two types: solid golf balls, which exhibit exceptional durability and flight distance, and thread-wound golf balls, which exhibit exceptional controllability and shot feel. Solid golf balls comprise a two-piece golf ball, of which a core is covered by a cover material, and a multi-layer structured golf ball, in which one or more intermediate layers are interposed between the core and cover.

The core of the solid golf balls is formed by a vulcanized molded article of rubber composition. The rubber composition comprises polybutadiene as a base rubber, a metal salt of α,β-unsaturated carboxylic acid and an organic peroxide. The metal salt of α,β-unsaturated carboxylic acid is grafted onto the polybutadiene main chain through the action of the organic peroxide, which serves as a free radical initiator, and functions as a co-crosslinking agent in the rubber composition. Since the vulcanized molded article of the rubber composition forms the three-dimensionally crosslinked structure therein, it is known to impart the core with a suitable degree of hardness and durability, and solid golf balls, in which such cores are employed, with exceptional durability, as well as good rebound characteristics and flight performance.

However, in comparison with conventional thread-wound golf balls, such solid golf balls have very hard shot feel as well as poor controllability at approach shot. In order to improve the shot feel, there has been an attempt of softening the core by lowering its hardness. The shot feel is improved as a result, but the rebound characteristics are degraded, which does not allow a sufficient flight distance to be obtained. In order to improve the controllability, an attempt of softening the cover has been proposed (Japanese Patent Kokai Publication No. 51406/1995). Whereas the spin performance is improved, the rebound characteristics of the cover are degraded, which led to the problem of sufficient flight performance of the resulting golf ball not being obtained.

Other attempts to accomplish an improvement in both the rebound characteristics and shot feel of solid golf balls have been made by compounding conventional core rubber compositions with various organic sulfide compounds (Japanese Patent Kokai Publication No. 244019/1998, Japanese Patent No. 2778229 and Japanese Patent No. 2669051). However, these attempts have still not yielded a golf ball that is satisfactory from the standpoints of both rebound characteristics and shot feel.

Japanese Patent Kokai Publication No. 89750/1987 proposes that 100 parts by weight of a blend of (A) a polybutadiene having a Mooney viscosity of 70 to 100 [$ML_{1+4}$(100° C.)], synthesized using nickel-containing catalyst and/or cobalt-containing catalyst, and (B) less than 50 parts by weight of a polybutadiene having a Mooney viscosity of 30 to 90 [$ML_{1+4}$(100° C.)], synthesized using a catalyst consisting of lanthanide rare earth elements-containing compound, or (C) from 20 to 80 parts by weight of a polybutadiene having a Mooney viscosity of 20 to 50 [$ML_{1+4}$(100° C.)], synthesized using nickel-containing catalyst and/or cobalt-containing catalyst can be suitably used as a rubber composition for golf balls. When the blend is used for the rubber composition, initial velocity of the resulting golf ball is improved. However, shot feel of the resulting golf ball is not described.

There has been no golf ball, which is sufficient to accomplish the balance between rebound characteristics and shot feel at the time of hitting. It has been required to provide golf balls, of which the shot feel and the flight performance are improved still more.

OBJECTS OF THE INVENTION

A main object of the present invention is to provide a solid golf ball having exceptional rebound characteristics and flight performance, as well as good shot feel.

According to the present invention, the object described above has been accomplished by employing polybutadiene rubber containing a cis-1,4-bond of not less than 99% as a base rubber, thereby providing a solid golf ball having exceptional rebound characteristics and flight performance, as well as good shot feel.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
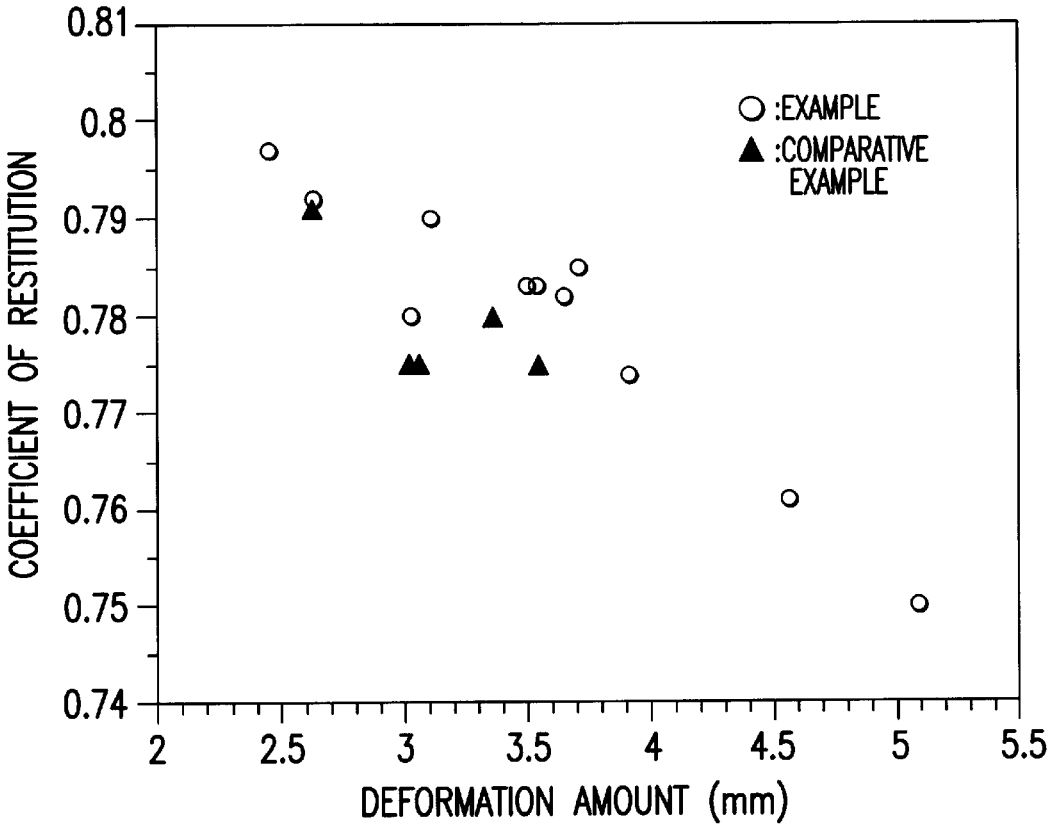
FIG. 1 is a graph illustrating the correlating between deformation amount (x-axis) and coefficient of restitution (y-axis) of the core in the golf ball of the present invention.
Figure 2:
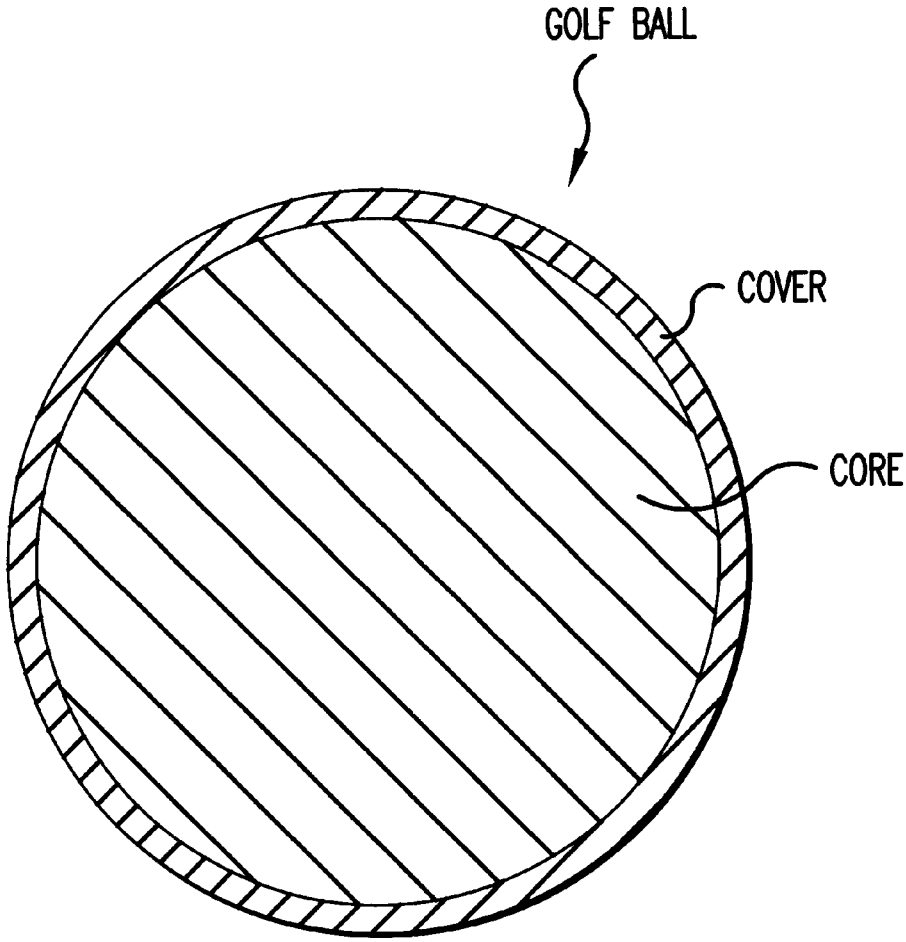
FIG. 2 depicts a golf ball of the present invention having a core and cover.

The present invention relates to a solid golf ball comprising at least one layer of a core, and at least one layer of a cover formed on the core, wherein at least one of the layers of the core is formed by vulcanizing and press-molding a rubber composition comprising (a) a base rubber comprising polybutadiene rubber containing a cis-1,4-bond of not less than 99%, (b) a co-crosslinking agent, and (c) an organic peroxide.

Since polybutadiene rubber having high content of a trans-bond has poor impact resilience, it is advantage to use polybutadiene rubber having high content of a cis-bond as a base rubber in golf balls.

DETAILED DESCRIPTION OF THE INVENTION

In the solid golf ball of the present invention, at least one layer of a cover is formed on at least one layer of a core. The core is obtained by press-molding a rubber composition under applied heat using a method and condition, which has been conventionally used for preparing solid cores of golf balls. The rubber composition contains a base rubber comprising polybutadiene rubber containing a cis-1,4-bond of not less than 99%, a co-crosslinking agent, an organic peroxide, optionally a filler, an organic sulfide compound and the like.

In the golf ball of the present invention, it is desired for the base rubber to comprise so-called high-cis polybutadiene rubber containing a cis-1,4-bond of not less than 99% in an amount of at least 40% by weight, preferably at least 50% by weight, more preferably 80% by weight, most preferably 100% by weight. The high-cis polybutadiene rubber may be optionally mixed with polybutadiene rubber containing a cis-1,4-bond of less than 99%, natural rubber, polyisoprene rubber, styrene-butadiene rubber, ethylene-propylene-diene rubber (EPDM) and the like.

The polybutadiene rubber containing a cis-1,4-bond of not less than 99% used in the present invention may be polybutadiene rubber synthesized by a known method, such as a method of synthesizing by using as a catalyst a metallocene type complex of a rare-earth metal compound described in Japanese Patent Kokai Publication No. 313710/2000, and is not limited as long as it has the above content of the cis-1,4-bond.

The co-crosslinking agent can be α,β-unsaturated carboxylic acids having 3 to 8 carbon atoms (e.g. acrylic acid, methacrylic acid, etc.) or a metal salt thereof, including mono or divalent metal salts, such as zinc, magnesium, or calcium salts and the like. The preferred; co-crosslinking agent is zinc acrylate, because it imparts high rebound characteristics to the resulting golf ball. The amount of the co-crosslinking agent is from 15 to 45 parts by weight, preferably from 20 to 35 parts by weight, based on 100 parts by weight of the base rubber. When the amount of the co-crosslinking agent is larger than 45 parts by weight, the core is too hard, and the shot feel of the resulting golf ball is poor. On the other hand, when the amount of the co-crosslinking agent is smaller than 15 parts by weight, it is required to increase the amount of the organic peroxide in order to impart a desired hardness to the core. Therefore, high rebound characteristics are not sufficiently obtained.

The organic peroxide, which acts as a crosslinking agent or curing agent, includes, for example, dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.2 to 5.0 parts by weight, preferably 1.0 to 2.5 parts by weight, based on 100 parts by weight of the base rubber. When the amount of the organic peroxide is smaller than 0.2 parts by weight, the core is too soft, and high rebound characteristics of the resulting golf ball are not sufficiently obtained. On the other hand, when the amount of the organic peroxide is larger than 5.0 parts by weight, it is required to decrease the amount of the co-crosslinking agent in order to impart a desired hardness to the core. Therefore, high rebound characteristics are not sufficiently obtained. When the organic peroxides are heated, they decompose to form radicals, which increase the degree of crosslinking between the co-crosslinking agent and base rubber, and enhance the rebound characteristics.

The filler is compounded as a specific gravity adjuster to mainly adjust the specific gravity of the resulting golf ball as the finished article to a range of 1.0 to 1.5, and can be optionally used in the rubber composition for the core of the present invention. The filler, which can be one typically used for the core of solid golf ball, includes for example, inorganic filler (such as zinc oxide, barium sulfate, calcium carbonate and the like), high specific gravity metal powder filler (such as tungsten powder, molybdenum powder and the like), and the mixture thereof. The particularly preferred filler is zinc oxide, which also functions as a vulcanization aid. The amount of the filler is from 2 to 30 parts by weight, preferably from 2 to 25 parts by weight, more preferably from 2 to 15 parts by weight, based on 100 parts by weight of the base rubber. When the amount of the filler is larger than 30 parts by weight, the rubber content in the core is small, and high rebound characteristics of the resulting golf ball are not sufficiently obtained. On the other hand, when the amount of the filler is smaller than 2 parts by weight, it is difficult to adjust the specific gravity of the resulting golf ball to the above range.

The organic sulfide compound, which can be one typically used for the core of solid golf ball, includes for example, thiophenols or metal salt thereof, such as zinc salt of pentachlorothiophenol and the like; disulfides, such as diphenyl disulfide and the like. The amount of the organic sulfide compound is 0.05 to 3.0 parts by weight, preferably 0.1 to 2.0 parts by weight, based on 100 parts by weight of the base rubber. When the amount of the organic sulfide compound is smaller than 0.05 parts by weight, the technical effect of improving the rebound characteristics of the golf ball is not sufficiently obtained. On the other hand, when the amount of the organic sulfide compound is larger than 3.0 parts by weight, the deformation amount is large, and the rebound characteristics are degraded.

The rubber compositions for the core of the golf ball of the present invention can contain other components, which have been conventionally used for preparing the core of solid golf balls, such as antioxidant or peptizing agent and the like. If used, the amount of the antioxidant is preferably not more than 0.5 parts by weight.

The core of the golf ball of the present invention can be obtained by uniformly mixing the rubber composition with a proper mixing machine such as a mixing roll, and then press-molding and vulcanizing the mixture under applied heat in a mold. The vulcanizing, of which the condition is not limited, is conducted at 130 to 240° C. and 2.9 to 11.8 MPa for 15 to 60 minutes.

In the golf ball of the present invention, it is preferable for the core to have a deformation amount when applying from an initial load of 98 N to a final load of 1275 N of 2.0 to 6.0 mm, preferably 2.4 to 5.1 mm, more preferably 3.1 to 5.1 mm, most preferably 3.9 to 5.1 mm. When the deformation amount of the core is smaller than 2.0 mm, the core is too hard, and the shot feel of the resulting golf ball is poor. On the other hand, when the deformation amount is larger than 6.0 mm, the core is too soft, and the durability of the resulting golf ball is poor and the rebound characteristics are degraded, which reduces the flight distance.

In the golf ball of the present invention, it is preferable for the core to have a diameter of 32.8 to 40.8 mm, preferably 33.6 to 40.0 mm. When the diameter of the core is smaller than 32.8 mm, the rebound characteristics are degraded, which reduces the flight distance. On the other hand, when the diameter of the core is larger than 40.8 mm, the cover is too thick, and the durability of the resulting golf ball is poor.

The core used in the golf ball of the present invention may have single-layered structure or multi-layered structure which has two or more layers. It is preferable for the core portion containing the rubber composition described above to have a volume of not less than 30%,.preferably not less than 50%, more preferably not less than 70%, and most preferably 100%, based on the total volume of the core. A cover is then covered on the core obtained as described above.

The cover used in the golf ball pertaining to the present invention may comprise a single-layered structure, or a multi-layered structure comprising two or more layers. The cover of the present invention contains thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum ion, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

As the materials suitably used in the cover of the present invention, the above ionomer resin may be used alone, but the ionomer resin may be used in combination with at least one of thermoplastic elastomer, diene-based block copolymer and the like.

Examples of the thermoplastic elastomers include polyamide-based thermoplastic elastomer, which is commercially available from Toray Co., Ltd. under the trade name of "Pebax" (such as "Pebax 2533"); polyester-based thermoplastic elastomer, which is commercially available from Toray-Do Pont Co., Ltd. under the trade name of "Hytrel" (such as "Hytrel 3548", "Hytrel 4047"); polyurethane-based elastomer, which is commercially available from Takeda Badishes Urethanes Industries, Ltd. under the trade name of "Elastollan" (such as "Elastollan ET880"); and the like.

The diene-based block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010"), the diene block copolymers, which are commercially available from Kuraray Co., Ltd. under the trade name of "Septon" (such as "Septon HG-252") and the like.

The amount of the thermoplastic elastomer or diene block copolymer is 0 to 60 parts by weight, preferably 10 to 40 parts by weight, based on 100 parts by weight of the base resin for the cover. When the amount is larger than 60 parts by weight, the cover is too soft, and the rebound characteristics of the resulting golf ball are degraded. In addition, the compatibility with the ionomer resin is degraded, and the durability is degraded.

The composition for the cover used in the present invention may optionally contain fillers, which are the same as used for the core, pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core with the cover is not specifically limited, but may be a conventional method. For example, there can be used a method comprising molding the cover composition into a semi-spherical half-shell in advance, covering the core, which is covered with the outer core, with the two half-shells, followed by pressure molding at 130 to 170° C. for 1 to 5 minutes, or a method comprising injection molding the cover composition directly on the core, which is covered with the core, to cover it.

It is desired for the cover to have a thickness of 1.0 to 5.0 mm, preferably 1.4 to 4.6 mm, more preferably 1.4 to 2.5 mm. When the thickness is smaller than 1.0 mm, the durability and rebound characteristics of the resulting golf ball are degraded. On the other hand, when the thickness is larger than 5.0 mm, the shot feel of the resulting golf ball is poor. If the cover has two or more layers, the thickness of each layer is not limited as long as the total thickness of the cover layers is within the above range.

At the time of molding the cover, many depressions called "dimples" may be optionally formed on the surface of the golf ball. Furthermore, paint finishing or marking with a stamp may be optionally provided after the cover molded for commercial purposes.

EXAMPLES

The following Examples and Comparative Examples further illustrate the present invention in detail but are not to be construed to limit the scope of the present invention.

Synthesis of High-cis Polybutadiene (99)

In a 2-liter autoclave purged with nitrogen, 2.5 mmol of bis(pentamethylcyclopentadienyl) bis(tetrahydrofuran)

samarium was charged, and was dissolved in 1.5 liters of toluene. To the resulting solution was added MMAO (toluene-soluble aluminoxane, which is commercially available from Tosoh Akzo Corporation) so as to be at a ratio of elements (Al/Sm) of 200. To the resulting solution was added 400 ml of 1,3-butadiene, and was polymerized at 50° C. for 5 minutes. After the polymerization, 2.5 liters of methanol containing 10% by weight of 2,6-bis(t-butyl)-4-methyl phenol was added to terminate the polymerization reaction. The resulting polymerizate was separated by a large amount of mixed solvent of methanol/hydrochloric acid, and the polymerizate was dried at 60° C. under vacuum. The resulting polymerizate had a content of a cis-1,4-bond of 99%, and a yield of 65% by weight.

Production of Core

Examples 1 to 9, 11 and Comparative Examples 1 to 5.

The rubber compositions for the core having the formulation shown in Tables 1 to 2 (Examples) and Table 3 (Comparative Examples) were mixed with a mixing roll, and then vulcanized by press-molding in the mold at 160° C. for 30 minutes to obtain cores having a diameter of 38.4 mm. The deformation amount and coefficient of restitution of the resulting core were measured. The results are shown in Tables 5 to 6 (Examples) and Table 7 (Comparative Examples).

Example 10

(i) Production of Spherical Vulcanized Molded Article for Inner Core

The rubber composition for the inner core having the formulation shown in Table 2 was mixed with a mixing roll, and then vulcanized by press-molding in the mold at 160° C. for 25 minutes to obtain spherical vulcanized molded article for the inner core having a diameter of 28.0 mm.

(ii) Production of Semi-vulcanized Semi-spherical Half-shell for the Outer Core

The rubber composition for the outer core having the formulation shown in Table 2 was mixed with a mixing roll, and then press-molded at 160° C. for 2 minutes in the mold having a semi-spherical convex having the same diameter as the vulcanized spherical molded article for the inner core produced in the step (i) to obtain semi-vulcanized semi-spherical half-shell for the outer core.

(iii) Production of Two-layer Structured Core

The vulcanized spherical molded article for the inner core produced in the step (i) was covered with the two semi-vulcanized semi-spherical half-shells for the outer core produced in the step (ii), and then vulcanized by press-molding at 160° C. for 25 minutes in the mold to obtain the two-layer structured core having a diameter of 38.2 mm. The deformation amount and coefficient of restitution of the resulting two-layer structured core was measured. The results are shown in Table 6 (Examples).

TABLE 1

| | (part by weight) Example No. | | | | |
|---|---|---|---|---|---|
| Core composition | 1 | 2 | 3 | 4 | 5 |
| BR-11 *1 | — | — | 50 | 20 | 20 |
| Hi-cis polybutadiene rubber (99) | 100 | 100 | 50 | 80 | 80 |

TABLE 1-continued

| | (part by weight) Example No. | | | | |
|---|---|---|---|---|---|
| Core composition | 1 | 2 | 3 | 4 | 5 |
| Zinc acrylate | 30 | 15 | 45 | 30 | 30 |
| Zinc oxide | 20 | 25.4 | 14.6 | 20 | 20 |
| Dicumyl peroxide | 0.5 | 0.5 | 0.5 | 0.5 | 0.5 |
| Pentachlorothiophenol zinc salt | — | 0.5 | 0.5 | 0.05 | 3.0 |

TABLE 2

| | (part by weight) Example No. | | | | | | |
|---|---|---|---|---|---|---|---|
| | | | | | 10 | | |
| Core composition | 6 | 7 | 8 | 9 | Inner layer | outer layer | 11 |
| BR-11 *1 | 30 | — | — | — | — | 100 | 60 |
| Hi-cis polybutadiene (99) | 70 | 100 | 100 | 100 | 100 | — | 40 |
| Zinc acrylate | 30 | 30 | 10 | 50 | 30 | 30 | 30 |
| Zinc oxide | 20 | 10 | 27.2 | 12.8 | 20 | 20 | 10 |
| Barium sulfate | — | 12 | — | — | — | — | 12 |
| Dicumyl peroxide | 0.5 | 0.5 | 3.0 | 0.5 | 0.5 | 0.5 | 0.5 |
| Pentachlorothiophenol zinc salt | — | 0.5 | — | — | — | — | 0.5 |
| Diphenyl disulfide | — | — | — | — | — | 0.5 | — |

TABLE 3

| | (part by weight) Comparative Example No. | | | | |
|---|---|---|---|---|---|
| Core composition | 1 | 2 | 3 | 4 | 5 |
| BR-11 *1 | 100 | 100 | 100 | 100 | 100 |
| Zinc acrylate | 30 | 30 | 30 | 30 | 45 |
| Zinc oxide | 20 | 20 | 20 | 10 | 14.6 |
| Barium sulfate | — | — | — | 12 | — |
| Dicumyl peroxide | 0.5 | 0.5 | 0.5 | 0.5 | 0.5 |
| Diphenyl disulfide | — | 0.5 | 0.5 | 0.5 | 0.5 |
| Pentachlorothiophenol zinc salt | — | — | — | — | — |

*1) Trade name; polybutadiene rubber, commercially available from JSR Co., Ltd. (Content of cis-1,4-bond: 96%, nickel-containing catalyst)

Preparation of Cover Compositions

The formulation materials shown in Table 3 were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 200 to 260° C. at the die position of the extruder.

TABLE 4

| Cover composition | | Amount (part by weight) |
|---|---|---|
| Hi-milan 1706 | *2 | 30 |
| Hi-milan 1707 | *3 | 30 |
| Hi-milan 1605 | *4 | 40 |
| Titanium dioxide | | 2 |
| Barium sulfate | | 2 |

*2: Hi-milan 1706 (trade name), ethylene-methacrylic acid copolymer-based ionomer resin obtained by neutralizing with zinc ion, manufactured by Du Pont-Mitsui Polychemicals Co., Ltd.
*3: Hi-milan 1707 (trade name), ethylene-methacrylic acid copolymer-based ionomer resin obtained by neutralizing with sodium ion, manufactured by Du Pont-Mitsui Polychemicals Co., Ltd.
*4: Hi-milan 1605 (trade name), ethylene-methacrylic acid copolymer-based ionomer resin obtained by neutralizing with sodium ion, manufactured by Du Pont-Mitsui Polychemicals Co., Ltd.

Examples 1 to 11 and Comparative Examples 1 to 5

The resulting cover compositions were preliminary molded into semi-spherical half-shells, encapsulating the resulting core with the two half-shells, followed by press-molding in the mold to form a cover layer having a thickness of 2.3 mm, and then coating with a paint to obtain a golf ball having a diameter of 42.8 mm. With respect to the resulting golf ball, the flight distance was measured and the shot feel was evaluated, and the results are shown in Tables 5 to 6 (Examples) and Table 7 (Comparative Examples). The test methods are as follows.

Test Methods (1) Deformation Amount of Core

The deformation amount of core was determined by measuring a deformation amount when applying from an initial load of 98 N to a final load of 1275 N on the core.

(2) Coefficient of Restitution of Core

A metal cylindrical article having weight of 198.4 g was struck at a speed of 40 m/sec against a golf ball core, and the velocity of the cylindrical article and the golf ball core before and after the strike was measured. The coefficient of restitution of the golf ball core was calculated from the velocity and the weight of both the cylindrical article and the golf ball core. The measurement was conducted by using 12 golf ball cores for each sample (n=12), and the average is shown as the coefficient of restitution of each core.

(3) Flight Distance

A No. 1 wood club (W#1, a driver) having metal head was mounted to a swing robot manufactured by True Temper Co. and the resulting golf ball was hit at a head speed of 45 m/sec, the flight distance was measured. As the flight distance, carry that is a distance to the dropping point of the hit golf ball was measured. The measurement was conducted by using 12 golf balls for every sample (n=12), and the average is shown as the result of the golf ball.

(4) Shot Feel

The shot feel of the resulting golf ball was evaluated by 10 golfers according to practical hitting test using a No. 1 wood club (a driver, W#1; "Newbreed Tour Forged" loft angle=8.5 degrees, manufactured by Sumitomo Rubber Industries, Ltd.). The evaluation criteria are as follows. The results shown in the Tables below are based on the fact that the most golfers evaluated with the same criterion about shot feel.

Evaluation Criteria oo: The golfers felt that the golf ball has very soft and good shot feel such that impact force at the time of hitting is very small.

o: The golfers felt that the golf ball has soft and good shot feel such that impact force at the time of hitting is small.

Δ: The golfers felt that the golf ball has fairly good shot feel.

x: The golfers felt that the golf ball has poor shot feel such that impact force at the time of hitting is large.

TABLE 5

| | Example No. | | | | |
|---|---|---|---|---|---|
| Test item | 1 | 2 | 3 | 4 | 5 |
| Deformation amount of core (mm) | 3.04 | 4.57 | 2.65 | 3.12 | 3.92 |
| Coefficient of restitution of core | 0.780 | 0.761 | 0.792 | 0.790 | 0.774 |
| Carry (m) | 197 | 191 | 202 | 201 | 194 |

TABLE 6

| | Example No. | | | | | |
|---|---|---|---|---|---|---|
| Test item | 6 | 7 | 8 | 9 | 10 | 11 |
| Deformation amount of core (mm) | 3.55 | 3.75 | 5.09 | 2.47 | 3.51 | 3.66 |
| Coefficient of restitution of core | 0.783 | 0.785 | 0.750 | 0.797 | 0.783 | 0.782 |
| Carry (m) | 198 | 199 | 188 | 203 | 198 | 194 |

TABLE 7

| | Comparative Example No. | | | | |
|---|---|---|---|---|---|
| Test item | 1 | 2 | 3 | 4 | 5 |
| Deformation amount of core (mm) | 3.03 | 3.37 | 3.07 | 3.55 | 2.64 |
| Coefficient of restitution of core | 0.775 | 0.780 | 0.775 | 0.775 | 0.791 |
| Carry (m) | 194 | 197 | 195 | 195 | 202 |

FIG. 1 is a graph illustrating the correlation between deformation amount (x-axis) and coefficient of restitution (y-axis) of the core of Examples 1 to 11 and Comparative Examples 1 to 5, based on the results shown in Tables 5 to 7. In FIG. 1, when the plot is in the area having higher value of the x-axis, that is, to the right in the graph, the deformation amount is larger and the impact force at the time of hitting is smaller, and the shot feel is good. In FIG. 1, when the plot is in the area having higher value of the y-axis, that is, to the upside in the graph, the coefficient of restitution is larger, and the flight distance is improved. Therefore when the plot is to the upper right in the graph, the golf ball has both good shot feel and excellent rebound characteristics (flight distance). As apparent from FIG. 1, in the golf balls of Examples 1 to 11, of which the base rubber in the rubber composition for the core comprises polybutadiene rubber containing a cis-1,4-bond of not less than 99%, the all plots are in the upper right area in the graph, as compared with the golf balls of Comparative Examples 1 to 5, of which the base rubber does not comprise the polybutadiene rubber.

Golf balls generally are prepared such that they have various values of deformation amount depending on the required performance. However, in FIG. 1, whatever deformation amount value the golf balls have, the golf balls of Examples have larger coefficient of restitution than those of Comparative Examples. In other words, the golf balls of Examples have more excellent rebound characteristics than those of Comparative Examples in the golf balls having approximately the same deformation amount (shot feel). Similarly, the golf balls of Examples have larger deformation amount and better shot feel than those of Comparative Examples in the golf balls having approximately the same rebound characteristics. In order to prove this, with respect to the golf balls of Example 4 and Comparative Example 5 having approximately the same coefficient of restitution, and the golf balls of Example 4 and Comparative Example 3 having approximately the same deformation amount, the shot feel was evaluated. The result is shown in Table 8 with the deformation amount and coefficient of restitution of the core, and the flight distance of the golf ball. The test method was described above.

TABLE 8

| | Example No. | Comparative Example No. | |
|---|---|---|---|
| Test item | 4 | 3 | 5 |
| Deformation amount of core (mm) | 3.12 | 3.07 | 2.64 |
| Coefficient of restitution of core | 0.790 | 0.775 | 0.791 |
| Carry (m) | 201 | 195 | 202 |
| Shot feel | ○○ | ○○ | x |

As apparent from the results shown in Table 8, the golf balls of Example 4 and Comparative Example 5 have approximately the same coefficient of restitution of core, but the golf ball of Example 4 having very large deformation amount has much better shot feel than that of Comparative Example 5. The golf balls of Example 4 and Comparative Example 3 have approximately the same deformation amount, and have the same shot feel. However, the golf ball of Example 4 has very larger coefficient of restitution of core and very larger flight distance than that of Comparative Example 3.

What is claimed is:

1. A solid golf ball comprising at least one layer of a core, and at least one layer of a cover formed on the core, wherein at least one of the layers of the core is formed by vulcanizing and press-molding a rubber composition comprising (a) a base rubber comprising polybutadiene rubber containing a cis-1,4-bond of not less than 99%, (b) a co-crosslinking agent, and (c) an organic peroxide, wherein the polybutadiene rubber containing a cis-1,4-bond of not less than 99% is synthesized by using a catalyst composition comprising (d) a metallocene type complex of a rare-earth metal compound and (e) an ionic compound consisting of a non-coordinating anion and cation and/or aluminoxane.

2. The golf ball according to claim 1, wherein the rubber composition for the core comprises 15 to 45 parts by weight of the co-crosslinking agent and 0.2 to 5 parts by weight of the organic peroxide, based on 100 parts by weight of the base rubber.

3. The golf ball according to claim 1, wherein the base rubber comprises at least 50% of polybutadiene rubber containing a cis-1,4-bond of not less than 99%.

4. The golf ball according to claim 1, wherein the rubber composition further comprises 0.05 to 3 parts by weight of an organic sulfide compound, based on 100 parts by weight of the base rubber.

5. The golf ball according to claim 1, wherein the base rubber comprises at least 70% of polybutadiene rubber containing a cis-1,4-bond of not less than 99%.

6. The golf ball according to claim 1, wherein the base rubber comprises 100% of polybutadiene rubber containing a cis-1, 4-bond of not less than 99%.

7. The golf ball according to claim 1, wherein the rubber composition for the core comprises 20 to 35 parts by weight of the co-crosslinking agent and 1.0 to 2.5 parts by weight of the organic peroxide, based on 100 parts by weight of the base rubber.

8. The golf ball according to claim 1, wherein the rubber composition further comprises 0.1 to 2.0 parts by weight of an organic sulfide compound, based on 100 parts by weight of the base rubber.

9. The golf ball according to claim 1, wherein the core has a single layer.

10. The golf ball according to claim 1, wherein the core has multiple layers.

* * * * *